US011756499B2

(12) United States Patent
Liu et al.

(10) Patent No.: US 11,756,499 B2
(45) Date of Patent: Sep. 12, 2023

(54) SCAN DRIVING CIRCUIT WITH REGISTER PART AND PULL-DOWN PART AND DISPLAY PANEL

(71) Applicant: TCL CHINA STAR OPTOELECTRONICS TECHNOLOGY CO., LTD., Guangdong (CN)

(72) Inventors: Yi Liu, Guangdong (CN); Ying Zhou, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/636,879

(22) PCT Filed: Jan. 27, 2022

(86) PCT No.: PCT/CN2022/074186
§ 371 (c)(1),
(2) Date: Feb. 20, 2022

(65) Prior Publication Data

US 2022/0358892 A1 Nov. 10, 2022

(30) Foreign Application Priority Data

Jan. 19, 2021 (CN) ..... 202210061543.9

(51) Int. Cl.
*G09G 3/36* (2006.01)

(52) U.S. Cl.
CPC ... *G09G 3/3677* (2013.01); *G09G 2300/0408* (2013.01); *G09G 2300/0819* (2013.01);
(Continued)

(58) Field of Classification Search
CPC ..... G09G 3/3677; G09G 2300/0408; G09G 2300/0819; G09G 2300/0842;
(Continued)

(56) References Cited

U.S. PATENT DOCUMENTS

2014/0320386 A1 10/2014 Li et al.
2018/0254016 A1* 9/2018 Wang ..... G09G 3/3677
(Continued)

FOREIGN PATENT DOCUMENTS

CN 103594118 A 2/2014
CN 106847227 A 6/2017
(Continued)

*Primary Examiner* — Kwang-Su Yang
(74) *Attorney, Agent, or Firm* — Mark M. Friedman

(57) ABSTRACT

A scan driving circuit and a display panel include an even number of signal wires divided into an odd group of signal wires and an even group of signal wires; and a plurality of scanning sub-circuits, each scanning sub-circuit including an assembly coupled between the odd group of signal wires and the even group of signal wires and including a register part and a pull-down part, and a load coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires.

15 Claims, 5 Drawing Sheets

(52) U.S. Cl.
CPC ..... *G09G 2300/0842* (2013.01); *G09G 2310/0286* (2013.01); *G09G 2310/061* (2013.01); *G09G 2310/08* (2013.01); *G09G 2320/0252* (2013.01); *G09G 2330/021* (2013.01)

(58) Field of Classification Search
CPC ..... G09G 2310/0286; G09G 2310/061; G09G 2310/08; G09G 2320/0252; G09G 2330/021
See application file for complete search history.

(56) References Cited

U.S. PATENT DOCUMENTS

| | | | | |
|---|---|---|---|---|
| 2019/0043412 | A1* | 2/2019 | Yang | G09G 3/3677 |
| 2019/0096499 | A1* | 3/2019 | Li | G09G 3/3677 |
| 2020/0286570 | A1* | 9/2020 | Shan | G09G 3/2092 |

FOREIGN PATENT DOCUMENTS

| | | | |
|---|---|---|---|
| CN | 108447453 | A | 8/2018 |
| CN | 112951140 | A | 6/2021 |
| CN | 113270072 | A | 8/2021 |

* cited by examiner

SCAN DRIVING CIRCUIT WITH REGISTER PART AND PULL-DOWN PART AND DISPLAY PANEL

FIELD OF INVENTION

The present disclosure relates to the technical field of display, and specifically to a scan driving circuit and a display panel.

BACKGROUND OF INVENTION

For a common display panel, GOA (gate driver on array) units on the left and right sides jointly drive horizontal scan lines. Pixels are connected in series in the scan lines with resistive-capacitive loads. For example, in a double-sided drive architecture, in order to drive all GOAs, the same number of clock (CK) wiring are symmetrically arranged on both sides of a circuit, wherein an even number (e.g., 2N) of clock wires need to be arranged on a single side of a bezel, resulting in a large wiring area required on the single side of the bezel, which does not meet requirements of narrow-bezel panels.

SUMMARY OF INVENTION

The present disclosure provides a scan driving circuit and a display panel, which are used to improve a problem of realizing a narrow-bezel panel in the prior art.

To solve the above problem, a first aspect of the present disclosure provides a scan driving circuit, which includes: an even number of signal wires divided into an odd group of signal wires and an even group of signal wires; and a plurality of scanning sub-circuits, wherein each of the scanning sub-circuits includes an assembly, the assembly is coupled between the odd group of signal wires and the even group of signal wires, the assembly includes a register part and a pull-down part, and a load is coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires; and wherein one of the register parts and one of the pull-down parts, both adjacent to each other on one side of the loads, are coupled to different signal wires among the same group of signal wires and configured in an integrated manner Therefore, a wiring-occupied area of one of the register parts and one of the pull-down parts both adjacent to each other on one side of the loads can be reduced, and a width of a bezel can be greatly reduced. In addition, the register part and the pull-down part can also be integrated into a drawing layout. In this way, the width of the border can be greatly reduced. After the drawing layout is integrated, the width of the register parts can be reduced. In addition to reducing the number of single-side signal wires, saving the width of the reduced register parts can reach 30% of the width of the original register parts, which can be applied to liquid crystal display panels. Further, it can also effectively disperse the signal wires to both sides of the loads by separating and alternately arranging the register parts and the pull-down parts to cause that the number of the signal wires on one side is halved, in which a width of a bezel can be greatly reduced to use a single-sided drive architecture for implementing the scan driving circuit.

According to an embodiment of the present disclosure, in the same assembly, one of the register part and the pull-down part is coupled between the load and one signal wire among the odd group of signal wires, and the other of the register part and the pull-down part is coupled between the load and one signal wire among the even group of signal wires. Therefore, the signal wires are effectively distributed to both sides of the loads, and the register part and the pull-down part in the same assembly are respectively coupled to one of the odd group of signal wires and one of the even group of signal wires located on different sides, which can significantly reduce the width of the bezel.

According to an embodiment of the present disclosure, a number of the even number of signal wires is 2N, and N is a positive integer; the scanning sub-circuits comprise an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N, i=2N, else, i=mod(n, 2N); and if (n+N−1) is an integer multiple of 2N, j=2N, else, j=mod(n+N−1, 2N). Therefore, it is beneficial to apply different scan driving circuits for realizing the improvement of the scan driving circuit without affecting the charging of pixels of a panel.

According to an embodiment of the present disclosure, a number of the even number of signal wires is 2N, and N is a positive integer; the scanning sub-circuits comprise an n-th scanning sub-circuit, and n is a positive integer; if n≤N, the register part in the n-th scanning sub-circuit inputs a preset start signal; and if n>N, the register part in an n-th scanning sub-circuit outputs a start signal to the register part in an (n+N)th scanning sub-circuit. Therefore, it is beneficial to apply different scan driving circuits for realizing the improvement of the scan driving circuit without affecting the charging of the pixels of the panel.

According to an embodiment of the present disclosure, a number of transistors involved in the register part is greater than a number of transistors involved in the pull-down part. Therefore, the number of transistors involved in the pull-down part is less than the number of transistors involved in the register part, a circuit architecture of the pull-down part can be effectively simplified, and the scan driving circuit is improved without affecting the charging of the pixels of the panel.

According to an embodiment of the present disclosure, the pull-down part includes a pull-down transistor, a control terminal of the pull-down transistor is coupled to a pulse port, a first terminal of the pull-down transistor is coupled to a scan-in port, a second terminal of the pull-down transistor is coupled to a low-potential port, and the load is coupled between the scan-in port of the pull-down part and a scan-out port of the register part. Therefore, the circuit structure of the pull-down part is effectively simplified, and the load is driven by the scan-out port of the register part and the scan-in port of the pull-down part, so as to realize the improvement of the scan driving circuit without affecting the charging of the pixels of the panel.

According to an embodiment of the present disclosure, a number of the even number of signal wires is 2N, and N is a positive integer; the even number of signal wires transmit an even number of pulse signals, in which a latter one of two sequentially adjacent pulse signals is delayed by one unit of time from a previous one of the two sequentially adjacent pulse signals in a transmission configuration, and each of the pulse signals is configured to be a pulse width modulated signal with a duty ratio of (N−1)/2N. Therefore, in accordance with this signal timing sequence, the register parts connected in a pull-down cascading manner are all odd-numbered or even-numbered stages, so the register parts cascaded with each other can be placed on the same side of the loads, and a configuration of half the number of the signal wires can be provided on the same side of the panel to facilitate the implementation of narrow-bezel panels.

To solve the above problems, a second aspect of the present disclosure provides a scan driving circuit, which includes: an even number of signal wires divided into an odd group of signal wires and an even group of signal wires; and a plurality of scanning sub-circuits, wherein each of the scanning sub-circuits includes an assembly, the assembly is coupled between the odd group of signal wires and the even group of signal wires, the assembly includes a register part and a pull-down part, and a load is coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires. Therefore, it can also effectively disperse the signal wires to both sides of the loads by separating and alternately arranging the register parts and the pull-down parts to cause that the number of the signal wires on one side is halved, in which a width of a bezel can be greatly reduced to use a single-sided drive architecture for implementing the scan driving circuit.

According to an embodiment of the present disclosure, in the same assembly, one of the register part and the pull-down part is coupled between the load and one signal wire among the odd group of signal wires, and the other of the register part and the pull-down part is coupled between the load and one signal wire among the even group of signal wires. Therefore, the signal wires are effectively distributed to both sides of the loads, and the register part and the pull-down part in the same assembly are respectively coupled to one of the odd group of signal wires and one of the even group of signal wires located on different sides, which can significantly reduce a width of a bezel.

According to an embodiment of the present disclosure, one of the register parts and one of the pull-down parts, both adjacent to each other on one side of the loads, are coupled to different signal wires among the same group of signal wires. Therefore, a wiring-occupied area of one of the register parts and one of the pull-down parts both adjacent to each other on one side of the loads can be reduced, and the width of the bezel can be greatly reduced.

According to an embodiment of the present disclosure, a number of the even number of signal wires is 2N, and N is a positive integer; the scanning sub-circuits comprise an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N, i=2N, else, i=mod(n, 2N); and if (n+N−1) is an integer multiple of 2N, j=2N, else, j=mod(n+N−1, 2N). Therefore, it is beneficial to apply different scan driving circuits for realizing the improvement of the scan driving circuit without affecting the charging of pixels of a panel.

According to an embodiment of the present disclosure, a number of the even number of signal wires is 2N, and N is a positive integer; the scanning sub-circuits comprise an n-th scanning sub-circuit, and n is a positive integer; if n≤N, the register part in the n-th scanning sub-circuit inputs a preset start signal; and if n>N, the register part in an n-th scanning sub-circuit outputs a start signal to the register part in an (n+N)th scanning sub-circuit. Therefore, it is beneficial to apply different scan driving circuits for realizing the improvement of the scan driving circuit without affecting the charging of the pixels of the panel.

According to an embodiment of the present disclosure, a number of transistors involved in the register part is greater than a number of transistors involved in the pull-down part. Therefore, the number of transistors involved in the pull-down part is less than the number of transistors involved in the register part, a circuit architecture of the pull-down part can be effectively simplified, and the scan driving circuit is improved without affecting the charging of the pixels of the panel.

According to an embodiment of the present disclosure, the pull-down part includes a pull-down transistor, a control terminal of the pull-down transistor is coupled to a pulse port, a first terminal of the pull-down transistor is coupled to a scan-in port, a second terminal of the pull-down transistor is coupled to a low-potential port, and the load is coupled between the scan-in port of the pull-down part and a scan-out port of the register part. Therefore, the circuit structure of the pull-down part is effectively simplified, and the load is driven by the scan-out port of the register part and the scan-in port of the pull-down part, so as to realize the improvement of the scan driving circuit without affecting the charging of the pixels of the panel.

According to an embodiment of the present disclosure, a number of the even number of signal wires is 2N, and N is a positive integer; the even number of signal wires transmit an even number of pulse signals, in which a latter one of two sequentially adjacent pulse signals is delayed by one unit of time from a previous one of the two sequentially adjacent pulse signals in a transmission configuration, and each of the pulse signals is configured to be a pulse width modulated signal with a duty ratio of (N−1)/2N. Therefore, in accordance with this signal timing sequence, the register parts connected in a pull-down cascading manner are all odd-numbered or even-numbered stages, so the register parts cascaded with each other can be placed on the same side of the loads, and a configuration of half the number of the signal wires can be provided on the same side of the panel to facilitate the implementation of narrow-bezel panels.

According to an embodiment of the present disclosure, one of the register parts and one of the pull-down parts, both adjacent to each other on one side of the loads, are configured in an integrated manner Therefore, the register part and the pull-down part can also be integrated into a drawing layout. In this way, the width of the border can be greatly reduced. After the drawing layout is integrated, the width of the register parts can be reduced. In addition to reducing the number of single-side signal wires, saving the width of the reduced register parts can reach 30% of the width of the original register parts, which can be applied to liquid crystal display panels.

To solve the above problem, a third aspect of the present disclosure provides a display panel including the above-mentioned scan driving circuit.

In the scan driving circuit and the display panel of the present disclosure, each of the scanning sub-circuits includes the assembly, the assembly is coupled between the odd group of signal wires and the even group of signal wires, and the assembly includes the register part and the pull-down part, the load is coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires. Therefore, the signal wires are effectively distributed to both sides of the loads, the number of signal wires on a single side is halved, and an area required for single-side wiring is reduced, which can greatly reduce a width of a bezel, reduce power consumption, and reduce delay to use a single-drive configuration to realize the scan driving circuit, thereby realizing the improvement of the circuit without affecting the charging of pixels of a pixel.

BRIEF DESCRIPTION OF DRAWINGS

To illustrate the technical solutions in the embodiments of the present disclosure more clearly, the accompanying drawings used in the description of the embodiments are briefly introduced as follows. Obviously, the accompanying drawings in the following description are only some embodiments of the present disclosure. For those skilled in the art, other drawings can also be obtained from these drawings without creative effort.

DETAILED DESCRIPTION OF PREFERRED EMBODIMENTS

Figure 1:
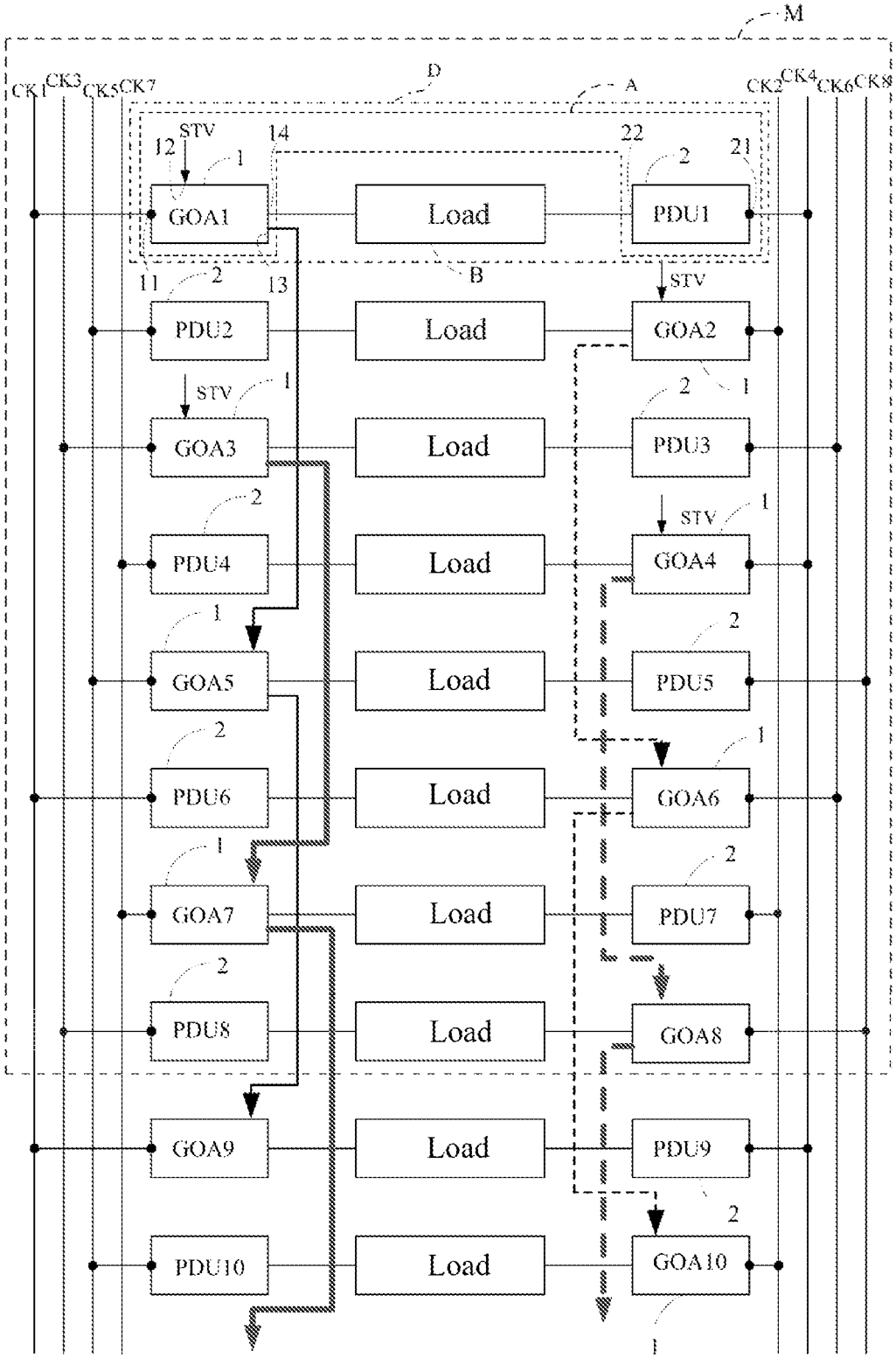
FIG. 1 is a schematic circuit diagram of a scan driving circuit in an embodiment of the present disclosure.

The technical solutions in the embodiments of the present disclosure will be clearly and completely described below with reference to the accompanying drawings in the embodiments of the present disclosure. Obviously, the described embodiments are only some, but not all, embodiments of the present disclosure. Based on the embodiments of the present disclosure, all other embodiments obtained by those skilled in the art without creative efforts shall fall within the protection scope of the present disclosure.

In the description herein, it should be understood that the terms, such as "center," "longitudinal," "lateral," "length," "width," "thickness," "upper," "lower," "front," "rear," "left," "right," "vertical," "horizontal," "top," "bottom," "inside," "outside," "clockwise," and "counterclockwise," instruct the relationship of orientation or position based on the orientation or positional relationship shown in the accompanying drawings, it is only for the convenience of describing the present disclosure and simplifying the description, rather than indicating or implying that the referred device or element has a specific orientation or is constructed and operated in a specific orientation. Therefore, it should not be construed as a limitation of the present disclosure.

In the description herein, it should be understood that the terms such as "first" and "second" are only used for descriptive purposes and cannot be interpreted as indicating or implying relative importance or implicitly indicating the number of indicated technical features. Thus, features defined as "first" and "second" may expressly or implicitly include one or more of said features. In the description of the present disclosure, "plurality" means two or more, unless otherwise expressly and specifically defined.

Numerous different embodiments or examples are provided herein for implementing different structures of the present disclosure. In order to simplify the content of the present disclosure, components and arrangements of specific examples are described below. Certainly, they are only examples and are not intended to limit the present disclosure. Furthermore, the present disclosure may repeat reference numerals and/or reference letters in different examples, this repetition is used for purposes of simplicity and clarity and itself does not indicate a relationship between the various embodiments and/or arrangements discussed. In addition, various examples of specific processes and materials are provided herein, but those ordinarily skilled in the art may recognize applications of other processes and/or the use of other materials.

For liquid crystal or light-emitting diode (LED) display panels, finding better solutions for a narrow bezel has always been the focus of research and development. Examples are described below but are not limited to the description here.

A first aspect of the present disclosure provides a scan driving circuit, which can be applied to a liquid crystal display panel, such as a liquid crystal display panel with a narrow bezel, but is not limited to the description here.

Embodiments of the scan driving circuit are illustrated below by examples but are not limited to the description here.

For example, as shown in FIG. 1, the scan driving circuit includes an even number of signal (CK) wires and a plurality of scanning sub-circuits D used for driving a plurality of horizontal scanning lines in a display panel. The scanning lines can be regarded as connecting a plurality of pixels in series (e.g., a plurality of pixels arranged laterally in a display panel). The scanning line is provided with resistive-capacitive loads. For example, a number of the even number of signal wires is 2N, and N is a positive integer, such as 2N=2 or 4 or 6 (e.g., 4CK or 6CK can be used for a small-size gaming screen), or 2N=8 (e.g., 8CK can be used for a medium-size television, etc.), or 2N=12 or 16 (e.g., 12CK or 16CK can be used for 8K monitors with high resolution).

It should be understood that if a number of CK wires is too small, a charging rate may be poor in the panel, and if the number of CK wires is too large, a bezel of a panel will be larger (not suitable for narrow-bezel panels). For example, for an 8K display, the charging rate of 12CK or 16CK is sufficient, and there is no need to add more CK wires. The following description only takes 10 rows of scan lines using 8CK as an example, and it is also applicable to other number of CK wires and scan lines and will not be repeatedly described. Herein, for convenience of description and to avoid over-complicated labeling, CKn (n is a positive integer) is used to represent different signal wires and the signals transmitted via the signal wires. For example, CK1 may be used to represent signal wire CK1 or signal CK1.

For example, as shown in FIG. 1, taking 8CK as an example, that is, 2N=8, the even number of signal wires (such as CK1, CK2, CK3, CK4, CK5, CK6, CK7, and CK8) can be configured into an odd group of signal wires (such as CK1, CK3, CK5, and CK7) and an even group of signal wires (such as CK2, CK4, CK6, and CK8).

In this example, taking 10 rows of scanning wires as an example, that is, n=1, 2, 3, . . . , or 10. The plurality of scanning sub-circuits D include ten scanning sub-circuits D.

Each of scanning sub-circuits D includes an assembly A. The assembly A is coupled between the odd group of signal wires (such as CK1, CK3, CK5, or CK7) and the even group of signal wires (such as CK2, CK4, CK6, or CK8), The assembly A includes a register part 1 and a pull-down part 2. For example, the register part 1 can be configured as a shift register (which is also marked as GOA). For example, the pull-down part 2 can be configured as a pull-down part (which is also marked as PDU). There is a load B coupled between the register part 1 and the pull-down part 2. For example, the load B can be configured to include a plurality of pixels connected in series, that is, the load B is provided with a resistive-capacitive load.

For the convenience of description, in this example, an assembly A of a 1st scanning sub-circuit D includes a register part 1 (shown as GOA1) and a pull-down part 2 (shown as PDU1); an assembly A of a 2nd scanning sub-circuit D includes a register part 1 (shown as GOA2) and a pull-down part 2 (shown as PDU2); an assembly A of a 3rd scanning sub-circuit D includes a register part 1 (shown as GOA3) and a pull-down part 2 (shown as PDU3); an assembly A of a 4th scanning sub-circuit D includes a register part 1 (such as GOA4) and a pull-down part 2 (such as PDU4); an assembly A of a 5th scanning sub-circuit D includes a register part 1 (such as GOA5) and a pull-down part 2 (shown as PDU5); an assembly A of a 6th scanning sub-circuit D includes a register part 1 (shown as GOA6) and a pull-down part 2 (shown as PDU6); an assembly A of a 7th scanning sub-circuit D includes a register part 1 (shown as GOAT) and a pull-down part 2 (such as PDU7); an assembly A of an 8th scanning sub-circuit D includes a register part 1 (shown as GOA8) and a pull-down part 2 (shown as PDU8); an assembly A of a 9th scanning sub-circuit D includes a register part 1 (shown as GOA9) and a pull-down part 2 (shown as PDU9); and an assembly A of a 10th scanning sub-circuit D includes a register part 1 (shown as GOA10) and a pull-down part 2 (shown as PDU10).

It should be noted that, as shown in FIG. 1, the register parts 1 and the pull-down parts 2 in the plurality of scanning sub-circuits D can be, for example, configured to be alternately arranged on both sides of the loads B. For example, the register part 1 (such as GOA1) of the 1st scanning sub-circuit D is arranged on one side (such as the left side) of the load B, and the pull-down part 2 (such as PDU1) of the 1st scanning sub-circuit D is arranged on the other side (such as the right side) of the load B; the pull-down part 2 (such as PDU2) of the 2nd scanning sub-circuit D is arranged on one side (such as the left side) of the load B, and the register part 1 (such as GOA2) of the 2nd scanning sub-circuit D is arranged on the other side (such as the right side) of the load B; the register part 1 (such as GOA3) of the 3rd scanning sub-circuit D is arranged on one side (such as the left side) of the load B, and the pull-down part 2 (such as PDU3) of the 3rd scanning sub-circuit D is arranged on the other side (such as the right side) of the load B; and the like, the pull-down part 2 (such as PDU10) of the 10th scanning sub-circuit D is arranged on one side (such as the left side) of the load B, and the register part 1 (such as GOA10) of the 10th scanning sub-circuit D is arranged on the other side (such as the right side) of the load B.

For example, as shown in FIG. 1, the register parts 1 and the pull-down parts 2 arranged on the same side of the loads B are alternately arranged. For example, the register parts 1 (such as GOA1, GOA3, GOA5, GOA7, and GOA9) of the odd-numbered scanning sub-circuits D and the pull-down parts 2 (such as PDU2, PDU4, PDU6, PDU8, and PDU10) of the even-numbered scanning sub-circuits D are arranged alternately stage by stage on one side (such as the left side) of the loads B, e.g., they are arranged as GOA1, PDU2, GOA3, PDU4, GOA5, PDU6, GOA7, PDU8, GOA9, and PDU10, from top to bottom. Also, the pull-down parts 2 (such as PDU1, PDU3, PDU5, PDU7, and PDU9) of odd-numbered scanning sub-circuits D and the register parts 1 (such as GOA2, GOA4, GOA6, GOA8, GOA10) of the even-numbered scanning sub-circuits D are arranged alternately stage by stage on the other side (such as the right side) of the loads B, e.g., they are arranged as PDU1, GOA2, PDU3, GOA4, PDU5, GOA6, PDU7, GOA8, PDU9, and GOA10, from top to bottom.

For example, as shown in FIG. 1, in the same assembly A, one of the register part 1 and the pull-down part 2 is coupled between the load B and one signal wire among the odd group of signal wires (e.g., CK1, CK3, CK5, and CK7), and the other one of the register part 1 and the pull-down part 2 is coupled between the load B and one signal wire among the even group of signal wires (e.g., CK2, CK4, CK6, and CK8). In addition, one of the register parts 1 and one of the pull-down parts 2, both adjacent to each other on one side of the loads B, are coupled to different signal wires among the same group of signal wires (such as the odd group of signal wires CK1, CK3, CK5, CK7 or the even group of signal wires CK2, CK4, CK6, CK8).

For the convenience of description, in this example, an 8-stage scanning sub-circuit cooperating to 8CK is taken as an example as a module M. There may be a plurality of modules M in a scan driving circuit.

For example, as shown in FIG. 1, in a single module M, the registers 1 (such as GOA1, GOA3, GOA5, and GOA7) of the odd-numbered (such as $1^{st}$-stage, $3^{rd}$-stage, $5^{th}$-stage, and $7^{th}$-stage) scanning sub-circuits D are respectively coupled to the odd group of signal wires (such as CK1, CK3, CK5, and CK7); and the register parts 1 (such as GOA2, GOA4, GOA6, and GOA8) of the even-numbered (such as the $2^{nd}$-stage, $4^{th}$-stage, $6^{th}$-stage, and $8^{th}$-stage) scanning sub-circuits D are respectively coupled to the even group of signal wires (such as CK2, CK4, CK6, and CK8). In addition, for different modules of the same scan driving circuit, numbering of the signal wires are sequentially incremented and assigned cyclically from 1 to 8, such as CK1, CK2, CK3, CK4, CK5, CK6, CK7, CK8, CK1, CK2, CK3, CK7, CK8, CK1, CK2, CK3, CK7, and CK8. For example, in the same assembly A, the signal wire for the pull-down part 2 and the signal wire for the register part 1 can maintain a numbering difference of (N−1).

For example, as shown in FIG. 1, taking 2N=8 (N=4) as an example, the signal wire for the pull-down part 2 and the signal wire for the register part 1 can maintain a numbering difference of (N−1=3). For example, the register part 1 (such as GOA1) of the 1st scanning sub-circuit D is coupled to the signal wire CK1, and the pull-down part 2 (such as PDU1) of the 1st scanning sub-circuit D is coupled to the signal wire CK4; the register part 1 (such as GOA2) of the 2nd scanning sub-circuit D is coupled to the signal wire CK2, and the pull-down part 2 (such as PDU2) of the 2nd scanning sub-circuit D is coupled to the signal wire CK5; the register part 1 (such as GOA3) of the 3rd scanning sub-circuit D is coupled to the signal wire CK3, and the pull-down part 2 (such as PDU3) of the 3rd scanning sub-circuit D is coupled to the signal wire CK6; the register part 1 (such as GOA4) of the 4th scanning sub-circuit D is coupled to the signal wire CK4, and the pull-down part 2 (such as PDU4) of the 4th scanning sub-circuit D is coupled to the signal wire CK7; the register part 1 (such as GOA5) of the 5th scanning sub-circuit D is coupled to the signal wire CK5, and the pull-down part 2 (such as PDU5) of the 5th scanning sub-circuit D is coupled to the signal wire CK8; the register part 1 (such as GOA6) of the 6th scanning sub-circuit D is coupled to the signal wire CK6, and the pull-down part 2 (such as PDU6) of the 6th scanning sub-circuit D is coupled to the signal wire CK1 (6+3=9, based on CK1 to CK8, using CK1); the register part 1 (such as GOAT) of the 7th scanning sub-circuit D is coupled to the signal wire CK7, and the pull-down part 2 (such as PDU7) of the 7th scanning sub-circuit D is coupled to the signal wire CK2 (7+3=10, based on CK1 to CK8, using CK2); the register part 1 (such as GOA8) of the 8th scanning sub-circuit D is coupled to the signal wire CK8, and the pull-down part 2 (such as PDU8) of the 8th scanning sub-circuit D is coupled to the signal wire CK3 (8+3=11, based on CK1 to CK8, using CK3); the register part 1 (such as GOA9) of the 9th scanning sub-circuit D is coupled to the signal wire CK1, the pull-down part 2 (such as PDU8) of the 9th scanning sub-circuit D is coupled to the signal wire CK4; . . . ; the register part (not shown) of the 13th stage scanning sub-circuit is coupled to the signal wire CK5, and the pull-down part (not shown) of the 13th scanning sub-circuit is coupled to the signal wire CK8; . . . ; the register part (not shown) of the 16th scanning sub-circuit is coupled to the signal wire CK8, and the pull-down part of the 16th scanning sub-circuit (not shown) is coupled to the signal wire CK3. Other connections can be understood according to the description here.

For example, as shown in FIG. 1, in an example configuration, the numbering of the signal wires coupled to the register part 1 and the pull-down part 2 can be configured according to a rule. For example, a number of the even number of signal wires is 2N, and N is a positive integer; the scanning sub-circuits include an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N (such as n=2N, 4N, 6N, . . . , i.e., mod(n, 2N)=0), i=2N, else, i=mod(n, 2N); and if (n+N−1) is an integer multiple of 2N (such as (n+N−1)=2N, 4N, 6N, . . . , i.e., mod(n, 2N)=0), j=2N, else, j=mod(n+N−1, 2N).

In this example, as shown in FIG. 1, for the convenience of description, the register part 1 may include a first pulse (Sync) port 11, a start input (Start1) port 12, a reset (Reset) port 13, and a scan-out (Output1) port 14, but is not limited to the description here. In other configurations, the register part 1 may also include other start input ports and/or scan-out ports. In addition, the pull-down part 2 may include a second pulse port 21 and a scan-in port 22 but is not limited to the description here. In other configurations, the pull-down part 2 may also include other ports, such as a low-potential port. In addition, the load B is coupled between the scan-out port 14 and the scan-in port 22.

Figure 2:
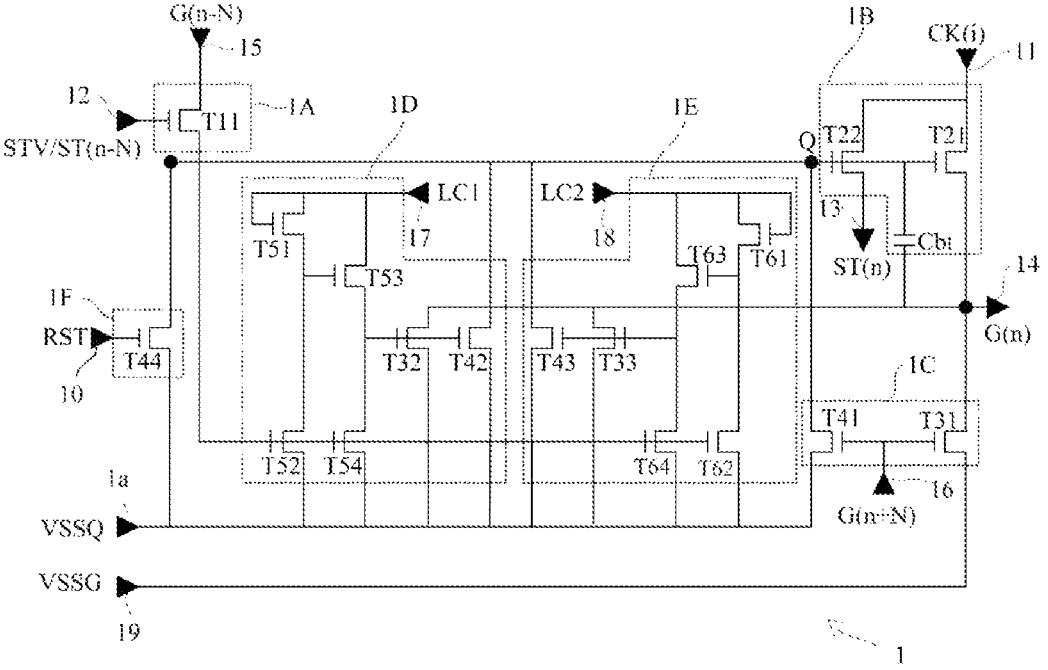
FIG. 2 is a schematic circuit diagram of a register part in an embodiment of the present disclosure.

For example, as shown in FIG. 2, for example, the register part 1 can be configured as a GOA (gate driver on array) circuit, which includes a plurality of transistors and a capacitor, wherein the transistor includes a control terminal, a first terminal, and a second terminal, and the transistor can be, for example, a thin film transistor (TFT) with a gate, a source, and a drain. For example, the register part 1 includes an input unit 1A, an output unit 1B, a maintenance unit 1C, a first control unit 1D, a second control unit 1E, and a re-setup unit 1F.

For example, as shown in FIG. 2, the input unit 1A includes a first transistor T11. A control terminal of the first transistor T11 is coupled to the start input port 12 for inputting a preset start signal STV or a previous start signal ST(n−N). A first terminal of the first transistor T11 is coupled to a previous scan port 15 for inputting a previous scan signal G(n−N).

For example, as shown in FIG. 2, the output unit 1B includes a second transistor T21, a third transistor T22, and a capacitor Cbt. A control terminal of the second transistor T21 and a control terminal of the third transistor T22 are coupled to a second terminal of the first transistor T11 to form a first connecting portion Q. A first terminal of the second transistor T21 and a first terminal of the third transistor T22 are coupled to a pulse port, such as a first pulse port 11, for inputting a first pulse signal CK(i). A second terminal of the second transistor T21 is coupled to the scan-out port 14 for outputting an n-th scan signal G(n). A second terminal of the third transistor T22 is coupled to a reset port 13 for outputting an n-th start signal ST(n). The capacitor Cbt is coupled between a control terminal and a second terminal of a second transistor T21.

For example, as shown in FIG. 2, the maintenance unit 1C includes a fourth transistor T31 and a fifth transistor T41. A control terminal of the fourth transistor T31 and a control terminal of the fifth transistor T41 are coupled to a later scan port 16 is used to input a later scan signal G(n+N). A first terminal of the fourth transistor T31 is coupled to the scan-out port 14. A second terminal of the fourth transistor T31 is coupled to a first low-potential port 19 for inputting a first low-potential signal VSSG. A first terminal of the fifth transistor T41 is coupled to the first connecting portion Q. A second terminal of the fifth transistor T41 is coupled to a second low-potential port 1*a* for inputting a second low-potential signal VSSQ.

For example, as shown in FIG. 2, the first control unit 1D includes a sixth transistor T51, a seventh transistor T52, an eighth transistor T53, a ninth transistor T54, a tenth transistor T32, and an eleventh transistor T42. A control terminal and a first terminal of the sixth transistor T51 and a first terminal of the eighth transistor T53 are coupled to a first control port 17 for inputting a first control signal LC1. A second terminal of the sixth transistor T51 is coupled to a first terminal of the seventh transistor T52 and a control terminal of the eighth transistor T53. A control terminal of the seventh transistor T52 and a control terminal of the ninth transistor T54 are coupled connected to a second terminal of the first transistor T11. A second terminal of the seventh transistor T52, a second terminal of the ninth transistor T54, a second terminal of the tenth transistor T32, and a second terminal of the eleventh transistor T42 are coupled to the second low-potential port 1*a*. A second terminal of the eighth transistor T53 is coupled to a first terminal of the ninth transistor T54, a control terminal of the tenth transistor T32, and a control terminal of the eleventh transistor T42. A first terminal of the tenth transistor T32 is coupled to the scan-out port 14. A first terminal of the eleventh transistor T42 is coupled to the first connecting portion Q.

For example, as shown in FIG. 2, the second control unit 1E includes a twelfth transistor T61, a thirteenth transistor T62, a fourteenth transistor T63, a fifteenth transistor T64, a sixteenth transistor T33, and a seventeenth transistor T43. A control terminal and a first terminal of the twelve transistors T61 and a first terminal of the fourteenth transistor T63 are coupled to a second control port 18 for inputting a second control signal LC2. A second terminal of the twelfth transistor T61 is coupled to a first terminal of the thirteenth transistor T62 and a control terminal of the fourteenth transistor T63. A control terminal of the thirteenth transistor T62 and a control terminal of the fifteenth transistor T64 are coupled to the second terminal of the first transistor T11. A second terminal of the thirteenth transistor T62, a second terminal of the fifteenth transistor T64, a second terminal of the sixteenth transistor T33, and a second terminal of the seventeenth transistor T43 are coupled to the second low-potential port 1*a*. A second terminal of the fourteenth transistor T63 is coupled to a first terminal of the fifteenth transistor T64, a control terminal of the sixteenth transistor T33, and a control terminal of the seventeenth transistor T43. A first terminal of the sixteenth transistor T33 is coupled to the scan-out port 14. A first terminal of the seventeen transistor T43 is coupled to the first connecting portion Q.

For example, as shown in FIG. 2, the re-setup unit 1F includes an eighteenth transistor T44. A control terminal of the eighteenth transistor T44 is coupled to a re-setup port 10 for inputting a re-setup signal RST. A first terminal of the eighteenth transistor T44 is coupled to the first connecting portion Q. A second terminal of the eighteenth transistor T44 is coupled to the second low-potential port 1*a*.

In this example, as shown in FIGS. 1 and 2, taking N=4 as an example, the first pulse port 11 can be used to input the first pulse signal CK(i), e.g., one pulse signal from the even number of signal wires (such as CK1 to CK8). In addition, the start input ports 12 of the register parts 1 of the 1st to 4th scanning sub-circuits D can input the preset start signal STV. The start input port 12 of the register part 1 of the n-th (n>4) scanning sub-circuit D can input an (n−4)th start signal ST(n−4), which is a start signal from the register part 1 of the (n−4) scanning sub-circuit D. The reset port 13 can output the n-th start signal ST(n). The scan-out port 14 can output the n-th scan signal G(n), which can be outputted to the load B for driving the load B of the n-th scanning sub-circuit D, such as a plurality of pixels connected in series in an n-th row scan line.

For example, as shown in FIG. 1, in the scan driving circuit, any two register parts 1 (such as GOA1, GOA5, GOA9, . . . , but not limited to the description here) that are separated by N of the scanning sub-circuits and configured on one side of the loads are cascaded with each other. For example, the number of the even number of signal wires is 2N, and N is a positive integer (in this example, N=4). The plurality of scanning sub-circuits D include an n-th scanning sub-circuit D, and n is a positive integer. If n≤N, the register part 1 in the n-th stage scanning sub-circuit D inputs the preset start signal STV. If n>N, the nth stage The register part 1 in the scanning sub-circuit D outputs the start signal ST(n) to the start input port 12 of the register part 1 in the (n+N)th scanning sub-circuit D.

Figure 3:
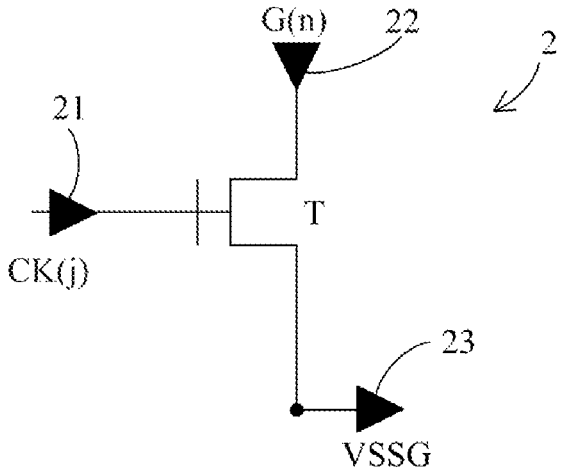
FIG. 3 is a schematic circuit diagram of a pull-down part in an embodiment of the present disclosure.

For example, as shown in FIGS. 1 and 3, the pull-down part 2 includes a pull-down transistor T, but is not limited to the description here, the pull-down part 2 may also include other components (such as other transistors). A control terminal of the pull-down transistor T is coupled to a pulse port, such as a second pulse port 21, for inputting a second pulse signal CK(j), e.g., a pulse signal from one signal wire among the even number of signal wires CK1 to CK8. A first terminal of the pull-down transistor T is coupled to a scan-in port 22 for inputting the n-th scan signal G(n) of the load B passing through the n-th scanning sub-circuit D. The second terminal is coupled to a low-potential port 23 for inputting the first low-potential signal VSSG. In this example, the n-th scan signal G(n) passing through the load B of the n-th scanning sub-circuit D can be conducted to the low-potential port 23 by the second pulse signal CK(j).

The following example illustrates the operation of the scan driving circuit according to the embodiment of the present disclosure. As shown in FIG. 1, the scan driving circuit belongs to a single-side driving pull-down GOA architecture. Taking 2N=8 as an example, the odd group of signal wires CK1, CK3, CK5, and CK7 are configured on one side of the loads B, and the even group of signal wires CK2, CK4, CK6, and CK8 is configured on the other side of the loads B, so that the number of signal wires on one side is halved, which is beneficial for applying to narrow-bezel panels. In addition, the register part 1 and the pull-down part 2 of the assembly A are alternately arranged in a horizontal and row by row manner on both sides of the loads B. The register part 1 can output the scan signal for driving the scan line, In this example, the pull-down part 2 is a single thin film transistor, which is controlled by a periodic square wave signal as a pulse signal. When the pulse signal is at a high level, the drain and source are conductive, and the potential of the scan line is pulled down. In addition, the register part 1 and the pull-down part 2 are alternately arranged in a vertical manner on one side of the loads B. For the square wave signal of the one-stage gate, only the register part 1 drives at a rising edge, and the register part 1 and the pull-down part 2 jointly drive at a falling edge. For a pre-charged gate waveform, the speed of the falling edge is a key factor affecting the in-plane charging.

Figure 4:
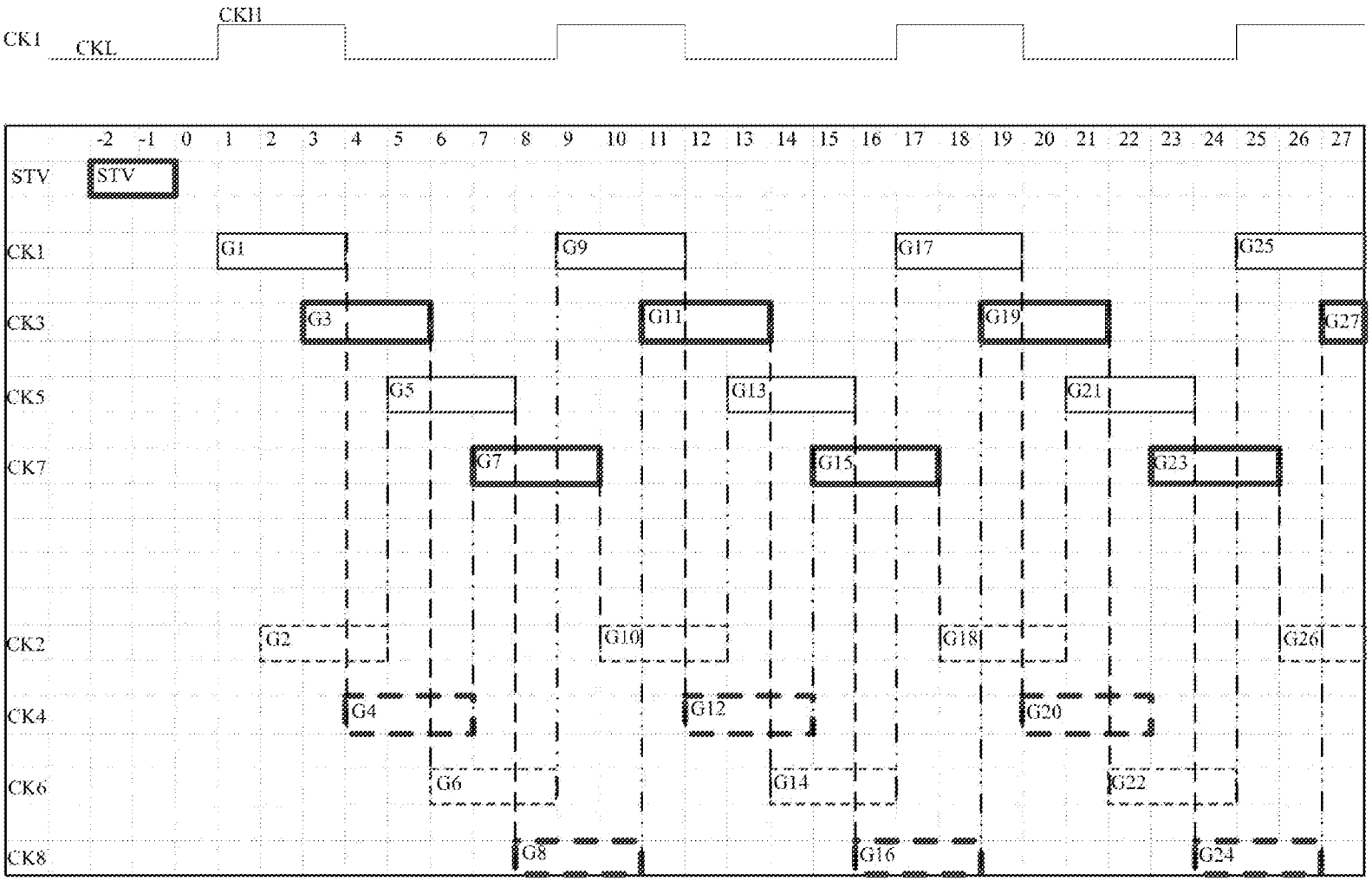
FIG. 4 is a timing diagram illustrating a pulse waveform and a cascade relationship of an 8CK architecture.

As shown in FIG. 4, taking 2N=8 as an example, the working principle of the above architecture is explained by using the timing of 8CK architecture. For simplicity, gate timing of the register part in 1st, 2nd, 3rd, . . . , and 27th scanning sub-circuits is represented as G1, G2, G3, . . . , and G27. Meanwhile, GOA1, GOA2, . . . are used to represent the register part 1 in the different scanning sub-circuits in FIG. 1. For all pulse signals CK (such as CK1 to CK8), their waveforms are periodic square wave signals, a high-level voltage of the square wave pulse signal is CKH, and a low-level voltage is CKL. For a system with 2N-numbered CK, a duty ratio of a pulse signal CK is set to (N−1)/2N.

In a timing diagram shown in FIG. 4, high-level periods of CK is marked by a long-bar-shaped block (e.g., G1, G2, G3, . . . , G5, . . . , G9, . . . , G26, G27, . . . , but not limited to the description here), wherein the time of its rising edge is indicated by the digital ruler in the upper digital square block. During a scanning operation, each gate signal will be synchronized with a high-level square wave of CK, and then remain in a low-level state. For example, for G1 driven by the signal wire CK1, the signal synchronized with G1 is as shown in the waveform of G1 in the figure. To simplify the representation, the high-level pulses synchronized by each gate signal are marked in high-level blocks of CK. In this architecture, a cascade with start signals is marked with the same kind of block.

For example, in FIGS. 1 and 4, a start signal STV turns on 1st to n-th register parts 1 (such as GOA1 to GOA(n)), e.g., in an 8CK system, previous four register parts 1 (such as GOA1 to GOA4))) use the start signal STV as a start signal. Afterward, as shown in the block, GOA1 provides a start signal to GOA5 (as shown in FIG. 4, block borderlines of G1 and G5 are both thin lines), and GOA5 provides a start signal to GOA9 (as shown in FIG. 4, block borderlines of G5 and G9 are both thin lines), and then GOA13, GOA17, GOA21, GOA25 are represented in sequence (as shown in FIG. 4, block borderlines of G13, G17, G21, and G25 are all thin lines). The same is true for other signals with the same block borderline, the description does not be repeated again here. However, a pull-down action of each gate is initiated by the pull-down part 2 on the opposite side of the register part 1, that is, a pull-down reset is provided, and a cascading relationship is indicated by the vertical line in the figure. For example, PDU1 on the opposite side of GOA1 is driven by a square-wave pulse provided by the signal wire CK4 which is provided to GOA4, so at moment 4, GOA1 loses synchronization with a signal CK1. The other pull-down relationships are consistent with the description here.

It can be seen that as shown in FIG. 4, in a transmission configuration, a latter one of two sequentially adjacent pulse signals is delayed by one unit of time from a previous one of the two sequentially adjacent pulse signals, e.g., a high-level period (such as G2) of the pulse signal CK2 is delayed by one unit of time than a high-level period (such as G1) of the pulse signal CK1, and a high-level period (such as G3) of the pulse signal CK3 is delayed by one unit of time than a high-level period (such as G2) of the pulse signal CK2, and the like for the rest of the signals. In addition, each of the pulse signals is configured to be a pulse width modulated signal with a duty ratio of (N−1)/2N.

It should be noted that the duty ratio of (N−1)/(2N) is an important factor for realizing a driving function of a single-side driving GOA-PDU architecture. Therefore, by this timing coordination, the GOAs connected in a pull-down cascading manner are all odd-numbered or even-numbered GOAs, so the cascaded GOAs can be placed on one side of the loads (such as pixels of a panel), and half the number of CK signal wires can be provided on the same side of the panel, which is conducive to realizing a narrow-bezel panel. The number of CKs required by each PDU with a pull-down function will undergo an odd-and-even transition. For example, the CK connected to the PDU corresponding to the odd-numbered GOA is an even-numbered CK, and the even-numbered CK is on the opposite side of an odd-numbered CK. For example, as shown in FIG. 1, the odd-numbered CKs on one side (e.g., the left side) provide drive for odd-numbered GOAs, while the even-numbered CKs on the other side (e.g., the right side) provide drive for even-numbered GOAs and provide pull-down drive for odd-numbered PDUs. Therefore, CK wiring on each side can be saved by half compared to traditional panels. For architectures with other numbers of CK such as 2N=12 or 2N=16, the method embodiments of the present disclosure are still applicable.

Figure 5:
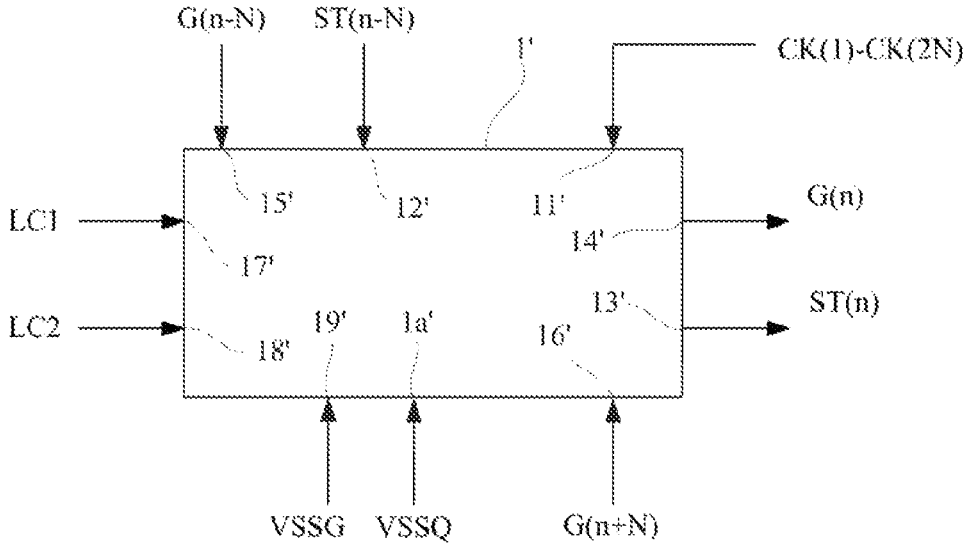
FIG. 5 is a block diagram of an exemplary shift register.

In a specific example, as shown in FIG. 5, for example, an exemplary shift register 1' includes a plurality of ports 11', 12', 13', 14', 15', 16', 17', 18', 19', and 1*a*'. The port 11' is used for inputting signals CK(1) to CK(2N) as synchronization (Sync) signals. The ports 12' and 15' are used for inputting signals ST(n−N) and G(n−N) as two start signals. The port 13' is used for outputting a signal ST(n). The port 14' is used for outputting a signal G(n). The port 15' is used for inputting a signal G(n−N). The port 16' is used for outputting a signal G(n+N) as a reset signal. The ports 17' and 18' are used for inputting signals LC1 and LC2. The ports 19' and 1*a*' are used for inputting signals VSSG and VSSQ.

The signals LC1 and LC2 are high-level signals. The signals VSSG and VSSQ are low-level DC signals, and these two signals are the pull-down power supply signals of a shift register. The signals LC1 and LC2 and the signals VSSG and VSSQ may also be simplified into a signal LC and a signal VSS. The two start signals are synchronous start signals, when the two start signals are both high, the shift register 1' is activated, and the ports 13' and 14' start to synchronize signals connected to the port 11' at this time. Assuming a GOA circuit is driven by 2N CK wires, then the signals G(n−N) and ST(n−N) are two start connection signals of the n-th stage shift register 1', and the signal G(n+N) or ST(n+N) are reset signals of the shift register 1'.

Figure 6:
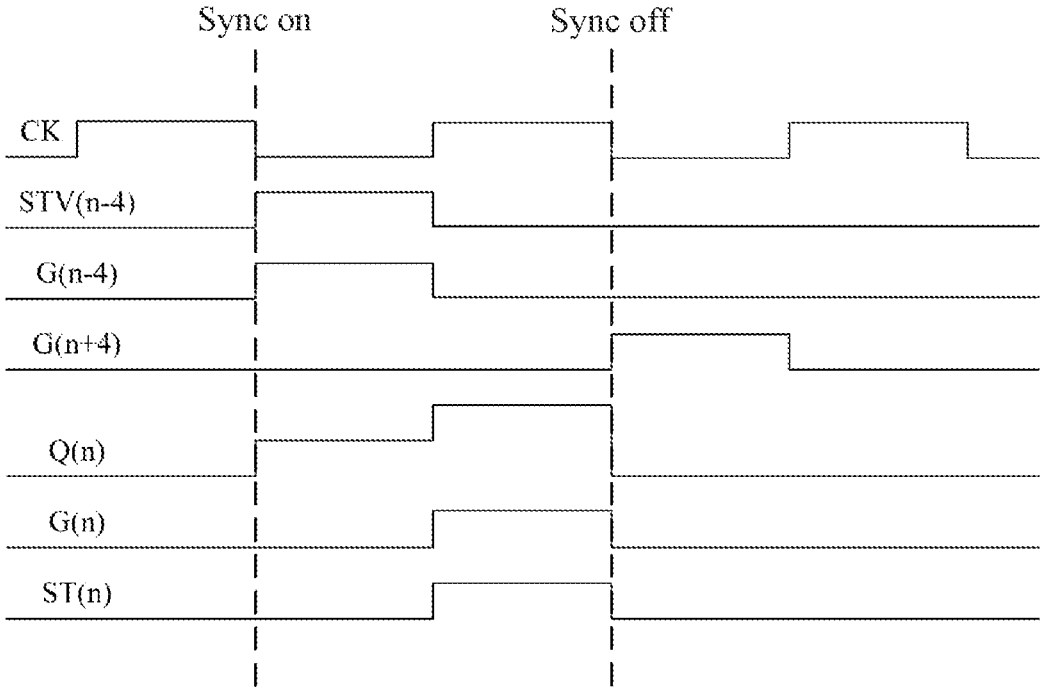
FIG. 6 is a diagram corresponding to a start-reset waveform of a single shift register.

For $1^{st}$-stage shift register 1', an independent start (STV) wire can be used to provide a start signal to the ports 12' and 15' when there is no signal outputted from a previous stage shift register as a start signal. FIG. 6 shows a GOA timing driven by 8CK, wherein ST(n−4) and G(n−4) are square-wave pulse signals that are a half CK cycle ahead, and G(N+4) is a square-wave pulse that is a half cycle delayed. The synchronization CK signal of an n-th shift register starts from times at rising edges of ST(n−4) (STV(n−4) as shown in the figure) and G(n−4), and time that synchronization is lost is the time at a rising edge of G(n+4). The output signals of the shift register 1' are ST(n) and G(n), and a signal of a first connecting portion in the shift register 1' is Q(n).

Figure 7:
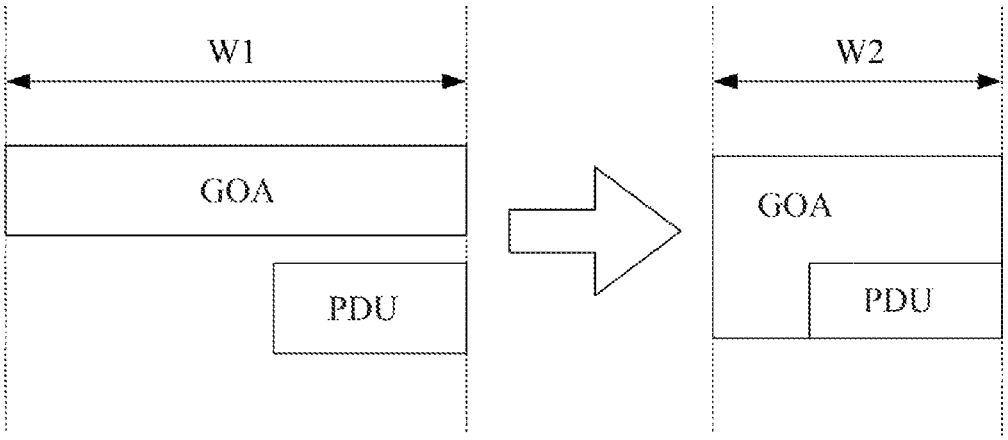
FIG. 7 is a schematic diagram of space-saving of an integrated layout of a register part and a pull-down part on the same side in an embodiment of the present disclosure.

It should be noted that, in a comparative example, e.g., a single scanning sub-circuit of a dual-side scan driving circuit includes two above shift registers 1' on both sides of a load, that is, one of the shift registers 1' is arranged on each side of the load. For example, the shift register 1' includes a GOA circuit including the above first transistor to the eighteenth transistor. In the comparative example, the shift register 1' includes eighteen transistors and a capacitor. In contrast, a single scanning sub-circuit D of the single-side scan driving circuit of the above embodiment includes the register part 1 and the pull-down part 2 on both sides of the load B. Only the register part 1 or the pull-down part 2 is arranged on one side of the load B, and the pull-down part 2 has only one transistor. In comparison, on one side of the load, the numbers of elements (e.g., transistors) of the pull-down part 2 and the shift register part 1' are significantly different. For the pull-down parts on the same side, the cascade relationship of the pull-down parts is consistent with the cascade relationship of the plurality of register parts. For example, a reset signal of a pull-down part 2 (such as PDU1) is an output signal of another pull-down part 2 (such as PDU5). A reset signal of another pull-down part 2 (such as PDU3) is an output signal of a pull-down part (such as PDU7), and the like. If the register part and the pull-down part adjacent to each other on the same side are configured in an integrated manner, e.g., by performing integrated drawing on a layout, as shown in FIG. 7, a left portion of the figure shows a GOA width W1 of a non-integrated configuration of the register part and the pull-down part adjacent to each other on the same side, and a right portion of the figure shows a GOA width W2 of an integrated configuration of the register part and the pull-down part adjacent to each other on the same side. It can be seen from the figure that by integrating the adjacent register part and the pull-down part on the same side, the GOA width can be reduced from W1 to W2, and the number of CK wires on one side is reduced. The resulting GOA width savings can reach 30% of the original GOA width.

As shown below, Table 1 is waveform comparison data of the shift register part 1' of the above-mentioned comparative example and the assembly A of the above-mentioned embodiment, applied to a liquid crystal panel. The high and low levels of the signal CK are 30V and −10V. By measuring times of a rising edge (referred to as "rising") and a falling edge (referred to as "falling") of a square wave for a gate at 9 points (left/middle/right-up/middle/down). It can be found that the right-down has the largest rising and falling times and is a point of maximum load. Compared with the GOA width W1 in FIG. 7 (e.g., the pull-down part and the register part adjacent to each other on the same side are not integrated), the rising time of the GOA width W2 in FIG. 7 (the pull-down part and the register part adjacent to the same side are integrated) is longer, about twice, but the falling time (that is an important indicator affecting the charging of in-plane pixels) is not much different. Therefore, by optimizing the size of thin-film transistors of the register part and the pull-down part in the assembly, the original falling time can be achieved.

TABLE 1

Comparison of load waveforms of different architectures

| Rising and falling measurement | CKH = 30 V CKL = −10 V | Left Rising (μs) | Left Falling (μs) | Left Peak (V) | Right Rising (μs) | Right Falling (μs) | Right Peak (V) | Middle Rising (μs) | Middle Falling (μs) | Middle Peak (V) |
|---|---|---|---|---|---|---|---|---|---|---|
| W1 | Down 1 | 3.556 | 2.86 | 29.62 | 3.666 | 3.001 | 29.62 | 3.55 | 2.86 | 29.62 |
| W2 | Down 1 | 6.302 | 3.111 | 27.06 | 7.449 | 3.503 | 25.81 | 7.487 | 3.37 | 25.53 |

Some embodiments of the scan driving circuit are illustrated below but are not limited to the description here.

An aspect of the present disclosure provides a scan driving circuit, which includes: an even number of signal wires divided into an odd group of signal wires and an even group of signal wires; and a plurality of scanning sub-circuits, wherein each of the scanning sub-circuits includes an assembly, the assembly is coupled between the odd group of signal wires and the even group of signal wires, the assembly includes a register part and a pull-down part, and a load is coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires. Therefore, it can also effectively disperse the signal wires to both sides of the loads by separating and alternately arranging the register parts and the pull-down parts to cause that the number of the signal wires on one side is halved, in which a width of a bezel can be greatly reduced to use a single-sided drive architecture for implementing the scan driving circuit.

Optionally, in one embodiment, in the same assembly, one of the register part and the pull-down part is coupled between the load and one signal wire among the odd group of signal wires, and the other of the register part and the pull-down part is coupled between the load and one signal wire among the even group of signal wires. Therefore, the signal wires are effectively distributed to both sides of the loads, and the register part and the pull-down part in the same assembly are respectively coupled to one of the odd group of signal wires and one of the even group of signal wires located on different sides, which can significantly reduce a width of a bezel.

Optionally, in one embodiment, one of the register parts and one of the pull-down parts, both adjacent to each other on one side of the loads, are coupled to different signal wires among the same group of signal wires. Therefore, a wiring-occupied area of one of the register parts and one of the pull-down parts both adjacent to each other on one side of the loads can be reduced, and the width of the bezel can be greatly reduced.

Optionally, in one embodiment, a number of the even number of signal wires is 2N, and N is a positive integer; the scanning sub-circuits comprise an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N, i=2N, else, i=mod(n, 2N); and if (n+N−1) is an integer multiple of 2N, j=2N, else, j=mod(n+N−1, 2N). Therefore, it is beneficial to apply different scan driving circuits for realizing the improvement of the scan driving circuit without affecting the charging of pixels of a panel.

Optionally, in one embodiment, a number of the even number of signal wires is 2N, and N is a positive integer; the scanning sub-circuits comprise an n-th scanning sub-circuit, and n is a positive integer; if n≤N, the register part in the n-th scanning sub-circuit inputs a preset start signal; and if n>N, the register part in an n-th scanning sub-circuit outputs a start signal to the register part in an (n+N)th scanning sub-circuit. Therefore, it is beneficial to apply different scan driving circuits for realizing the improvement of the scan driving circuit without affecting the charging of the pixels of the panel.

Optionally, in one embodiment, a number of transistors involved in the register part is greater than a number of transistors involved in the pull-down part. Therefore, the number of transistors involved in the pull-down part is less than the number of transistors involved in the register part, a circuit architecture of the pull-down part can be effectively simplified, and the scan driving circuit is improved without affecting the charging of the pixels of the panel.

Optionally, in one embodiment, the pull-down part includes a pull-down transistor, a control terminal of the pull-down transistor is coupled to a pulse port, a first terminal of the pull-down transistor is coupled to a scan-in port, a second terminal of the pull-down transistor is coupled to a low-potential port, and the load is coupled between the scan-in port of the pull-down part and a scan-out port of the register part. Therefore, the circuit structure of the pull-down part is effectively simplified, and the load is driven by the scan-out port of the register part and the scan-in port of the pull-down part, so as to realize the improvement of the scan driving circuit without affecting the charging of the pixels of the panel.

Optionally, in one embodiment, a number of the even number of signal wires is 2N, and N is a positive integer; the even number of signal wires transmit an even number of pulse signals, in which a latter one of two sequentially adjacent pulse signals is delayed by one unit of time from a previous one of the two sequentially adjacent pulse signals in a transmission configuration, and each of the pulse signals is configured to be a pulse width modulated signal with a duty ratio of (N−1)/2N. Therefore, in accordance with this signal timing sequence, the register parts connected in a pull-down cascading manner are all odd-numbered or even-numbered stages, so the register parts cascaded with each other can be placed on the same side of the loads, and a configuration of half the number of the signal wires can be provided on the same side of the panel to facilitate the implementation of narrow-bezel panels.

Optionally, in one embodiment, one of the register parts and one of the pull-down parts, both adjacent to each other on one side of the loads, are configured in an integrated manner Therefore, the register part and the pull-down part can also be integrated into a drawing layout. In this way, the width of the border can be greatly reduced. After the drawing layout is integrated, the width of the register parts can be reduced. In addition to reducing the number of single-side signal wires, saving the width of the reduced register parts can reach 30% of the width of the original register parts, which can be applied to liquid crystal display panels.

In addition, another aspect of the present disclosure provides a display panel, such as a liquid crystal display panel, the display panel includes the scan driving circuit as described above, and its implementation content and beneficial effects are described above, and will not be repeated here.

In the scan driving circuit and the display panel of the above embodiments of the present disclosure, each of the scanning sub-circuits includes the assembly, the assembly is coupled between the odd group of signal wires and the even group of signal wires, and the assembly includes the register part and the pull-down part, the load is coupled between the register part and the pull-down part; wherein the register parts and the pull-down parts that are configured on a same side of the loads are alternately arranged, and any two of the register parts that are separated by N of the scanning sub-circuits and configured on one side of the loads are cascaded with each other, wherein N is half of a total number of the even number of signal wires. Therefore, the signal wires are effectively distributed to both sides of the loads, the number of signal wires on a single side is halved, and an area required for single-side wiring is reduced, which can greatly reduce a width of a bezel, reduce power consumption, and reduce delay to use a single-drive configuration to realize the scan driving circuit, thereby realizing the improvement of the circuit without affecting the charging of pixels of a pixel.

Embodiments of the present disclosure are described above in detail. Principles and implementations of the present disclosure are described herein using specific examples. Descriptions of the above embodiments are only used to help understand the technical solutions and core ideas of the present disclosure. A skilled person should understand that it is still possible to modify the technical solutions recorded in the previous embodiments or perform equivalent replacements on some technical features. In addition, these modifications or replacements do not make the essence of the corresponding technical solutions deviate from examples of the scope of technical solutions of the present disclosure.

What is claimed is:

1. A scan driving circuit, comprising:

an even number of signal wires divided into an odd group of signal wires and an even group of signal wires; and a plurality of scanning sub-circuits, wherein each of the scanning sub-circuits comprises an assembly, the assembly is coupled between the odd group of signal wires and the even group of signal wires, the assembly comprises a register part and a pull-down part, and a load is coupled between the register part and the pull-down part, wherein the register parts and the pull-down parts that are configured on a same side of the loads are alternately arranged, and any two of the register parts that are separated by M of the scanning sub-circuits and configured on one side of the loads are cascaded with each other, wherein M is half of a total number of the even number of signal wires, wherein one of the register parts and one of the pull-down parts, both adjacent to each other on one side of the loads, are coupled to different signal wires among the same group of signal wires and configured in an integrated manner, and;

wherein: a number of the even number of signal wires is 2N, and N is a positive integer;

the scanning sub-circuits comprise an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N, i=2N, else, i=mod(n, 2N), and if (n+N−1) is an integer multiple of 2N, j=2N, else, j=mod(n+N−1, 2N).

2. The scan driving circuit as claimed in claim 1, wherein in the same assembly, one of the register part and the pull-down part is coupled between the load and one signal wire among the odd group of signal wires, and the other of the register part and the pull-down part is coupled between the load and one signal wire among the even group of signal wires.

3. The scan driving circuit as claimed in claim 1, wherein:

the scanning sub-circuits comprise an n-th scanning sub-circuit; and if n≤N, the register part in the n-th scanning sub-circuit inputs a preset start signal, and if n>N, the register part in an n-th scanning sub-circuit outputs a start signal to the register part in an (n+N)th scanning sub-circuit.

4. The scan driving circuit as claimed in claim 1, wherein a number of transistors involved in the register part is greater than a number of transistors involved in the pull-down part.

5. The scan driving circuit as claimed in claim 1, wherein the pull-down part comprises a pull-down transistor, a control terminal of the pull-down transistor is coupled to a pulse port, a first terminal of the pull-down transistor is coupled to a scan-in port, a second terminal of the pull-down transistor is coupled to a low-potential port, and the load is coupled between the scan-in port of the pull-down part and a scan-out port of the register part.

6. The scan driving circuit as claimed in claim 1, wherein:

the even number of signal wires transmit an even number of pulse signals, in which a latter one of two sequentially adjacent pulse signals is delayed by one unit of time from a previous one of the two sequentially adjacent pulse signals in a transmission configuration; and each of the pulse signals is configured to be a pulse width modulated signal with a duty ratio of (N−1)/2N.

7. A scan driving circuit, comprising:

an even number of signal wires divided into an odd group of signal wires and an even group of signal wires; and a plurality of scanning sub-circuits, wherein each of the scanning sub-circuits comprises an assembly, the assembly is coupled between the odd group of signal wires and the even group of signal wires, the assembly comprises a register part and a pull-down part, and a load is coupled between the register part and the pull-down part, wherein the register parts and the pull-down parts that are configured on a same side of the loads are alternately arranged, and any two of the register parts that are separated by M of the scanning sub-circuits and configured on one side of the loads are cascaded with each other, wherein M is half of a total number of the even number of signal wires, and wherein: a number of the even number of signal wires is 2N, and N is a positive integer;

the scanning sub-circuits comprise an n-th scanning sub-circuit, n is a positive integer, the register part in the n-th scanning sub-circuit is coupled to an i-th signal wire, and the pull-down part in the n-th scanning sub-circuit is coupled to a j-th signal wire; and if n is an integer multiple of 2N, i=2N, else, i=mod(n, 2N), and if (n+N−1) is an integer multiple of 2N, j=2N, else, j=mod(n+N−1, 2N).

8. The scan driving circuit as claimed in claim 7, wherein in the same assembly, one of the register part and the pull-down part is coupled between the load and one signal wire among the odd group of signal wires, and the other of the register part and the pull-down part is coupled between the load and one signal wire among the even group of signal wires.

9. The scan driving circuit as claimed in claim 7, wherein one of the register parts and one of the pull-down parts, both adjacent to each other on one side of the loads, are coupled to different signal wires among the same group of signal wires.

10. The scan driving circuit as claimed in claim 7, wherein:

the scanning sub-circuits comprise an n-th scanning sub-circuit; and if n≤N, the register part in the n-th scanning sub-circuit inputs a preset start signal, and if n>N, the register part in an n-th scanning sub-circuit outputs a start signal to the register part in an (n+N)th scanning sub-circuit.

11. The scan driving circuit as claimed in claim 7, wherein a number of transistors involved in the register part is greater than a number of transistors involved in the pull-down part.

12. The scan driving circuit as claimed in claim 7, wherein the pull-down part comprises a pull-down transistor, a control terminal of the pull-down transistor is coupled to a pulse port, a first terminal of the pull-down transistor is coupled to a scan-in port, a second terminal of the pull-down transistor is coupled to a low-potential port, and the load is coupled between the scan-in port of the pull-down part and a scan-out port of the register part.

13. The scan driving circuit as claimed in claim 7, wherein:

the even number of signal wires transmit an even number of pulse signals, in which a latter one of two sequentially adjacent pulse signals is delayed by one unit of time from a previous one of the two sequentially adjacent pulse signals in a transmission configuration; and each of the pulse signals is configured to be a pulse width modulated signal with a duty ratio of (N−1)/2N.

14. The scan driving circuit as claimed in claim 7, wherein one of the register parts and one of the pull-down parts, both adjacent to each other on one side of the loads, are configured in an integrated manner.

15. A display panel comprising the scan driving circuit as claimed in claim 7.

* * * * *